US005964573A

United States Patent [19]

Fischer

[11] Patent Number: 5,964,573

[45] Date of Patent: Oct. 12, 1999

[54] HOUSING FOR A SIDE CHANNEL COMPRESSOR

[75] Inventor: Peter Fischer, Nürnberg, Germany

[73] Assignee: Siemens Aktiengesellschaft, München

[21] Appl. No.: 09/043,282

[22] PCT Filed: Sep. 2, 1996

[86] PCT No.: PCT/DE96/01625

§ 371 Date: Sep. 14, 1998

§ 102(e) Date: Sep. 14, 1998

[87] PCT Pub. No.: WO97/10438

PCT Pub. Date: Mar. 20, 1997

[30] Foreign Application Priority Data

Sep. 15, 1995 [DE] Germany ..... 195 34 293

[51] Int. Cl.[6] ..... F04D 29/42; F01D 1/12; F01D 25/24

[52] U.S. Cl. ..... 415/55.1; 415/55.1; 415/55.2; 415/55.3; 415/55.4; 415/214.1; 415/182.1

[58] Field of Search ..... 415/55.1, 55.2, 415/55.3, 55.4, 214.1, 182.1

[56] References Cited

U.S. PATENT DOCUMENTS

| | | | |
|---|---|---|---|
| 3,782,850 | 1/1974 | Egli et al. | 415/53 T |
| 3,915,589 | 10/1975 | Vander Linden | 415/153 A |
| 3,951,567 | 4/1976 | Rohs | 415/119 |
| 4,197,051 | 4/1980 | Egli et al. | 415/53 T |
| 4,376,613 | 3/1983 | Schoenwald | 415/53 T |
| 5,350,274 | 9/1994 | Schmid et al. | 415/55.1 |
| 5,591,000 | 1/1997 | Fischer | 415/55.5 |
| 5,605,443 | 2/1997 | Schoning et al. | 415/214.1 |

FOREIGN PATENT DOCUMENTS

| | | |
|---|---|---|
| 2 239 023 | 2/1973 | Germany . |
| 77 14 651 U | 5/1977 | Germany . |
| 92 15 231 U | 4/1994 | Germany . |
| WO 89/06318 | 7/1989 | WIPO . |

*Primary Examiner*—F. Daniel Lopez
*Assistant Examiner*—Rhonda Barton
*Attorney, Agent, or Firm*—Kenyon & Kenyon

[57] ABSTRACT

The invention relates to a housing consisting of two housing halves for a side channel compressor. The strength of such a housing can be appreciably increased in that the front wall (3) of each housing half (1) and (2) has formed on it at least two rings (4) and (5), spaced radially from one another and projecting axially relative to the front wall (3), and rib walls (7) extending in a spoke-like manner between these rings (4) and (5).

11 Claims, 2 Drawing Sheets

HOUSING FOR A SIDE CHANNEL COMPRESSOR

BACKGROUND OF THE INVENTION

The invention relates to a housing consisting of two housing halves for a side channel compressor.

Such a housing is known from DE-U-92 15 231. In that housing, the housing halves consist of metal, for example aluminum, and therefore have sufficient strength.

SUMMARY OF THE INVENTION

The object on which the invention is based is to design the housing of a side channel compressor in such a way that, when it is produced from a material, for example plastic, having lower strength than metal, it can withstand the loads which occur during operation.

This object is achieved, according to the invention, by forming in the front wall of each housing half at least two rings, spaced radially from one another and projecting axially relative to the front wall, and rib walls extending in a spoke-like manner between these rings. Such a housing, even when produced from plastic, has sufficient strength.

Since the radius of the rings corresponds approximately to the outer and the inner radius of the side channel formed in the housing halves, the rib walls come to rest on the outside of the wall part forming the side channel. Since it is precisely these wall parts which are subjected to the compression pressure, it is beneficial that these wall parts are supported correspondingly by the rib walls.

One of the rings can advantageously be designed as the centering ring.

A further increase in the strength of the housing can be achieved by forming in the front wall, in addition to the two rings, an axially extended centering ring located radially further inward, and by providing further rib walls extending in a spoke-like manner on the front wall between the centering ring and the ring adjacent to the centering ring.

Since the further rib walls are arranged in a manner staggered relative to the rib walls, the ring located between the further rib walls and the rib walls contributes to increasing the strength of the housing, since at least some of the load forces are conducted via this ring.

Furthermore, radially extended reinforcing ribs can additionally be formed on the front wall between the centering ring and a hub extension located radially further inward relative to the centering ring. With this arrangement, virtually the entire front wall of each housing half is appropriately reinforced.

Producing the housing halves from plastic affords the possibility, furthermore, of providing on each housing half, at the end circumferential edge lying in the parting plane of the housing halves, a sealing lip extending over one half of the circumference and a sealing groove extending over the other half of the circumference. By means of these sealing lips and sealing grooves which engage one in the other when the housing halves are assembled, a sufficient sealing of the parting gap between the two housing halves is achieved.

If the sealing lip and sealing groove extend in each case on one side and another in relation to a symmetrical dividing line of the housing halves, then an identical design of the two housing halves is possible.

DETAILED DESCRIPTION OF THE DRAWINGS

Figure 1:
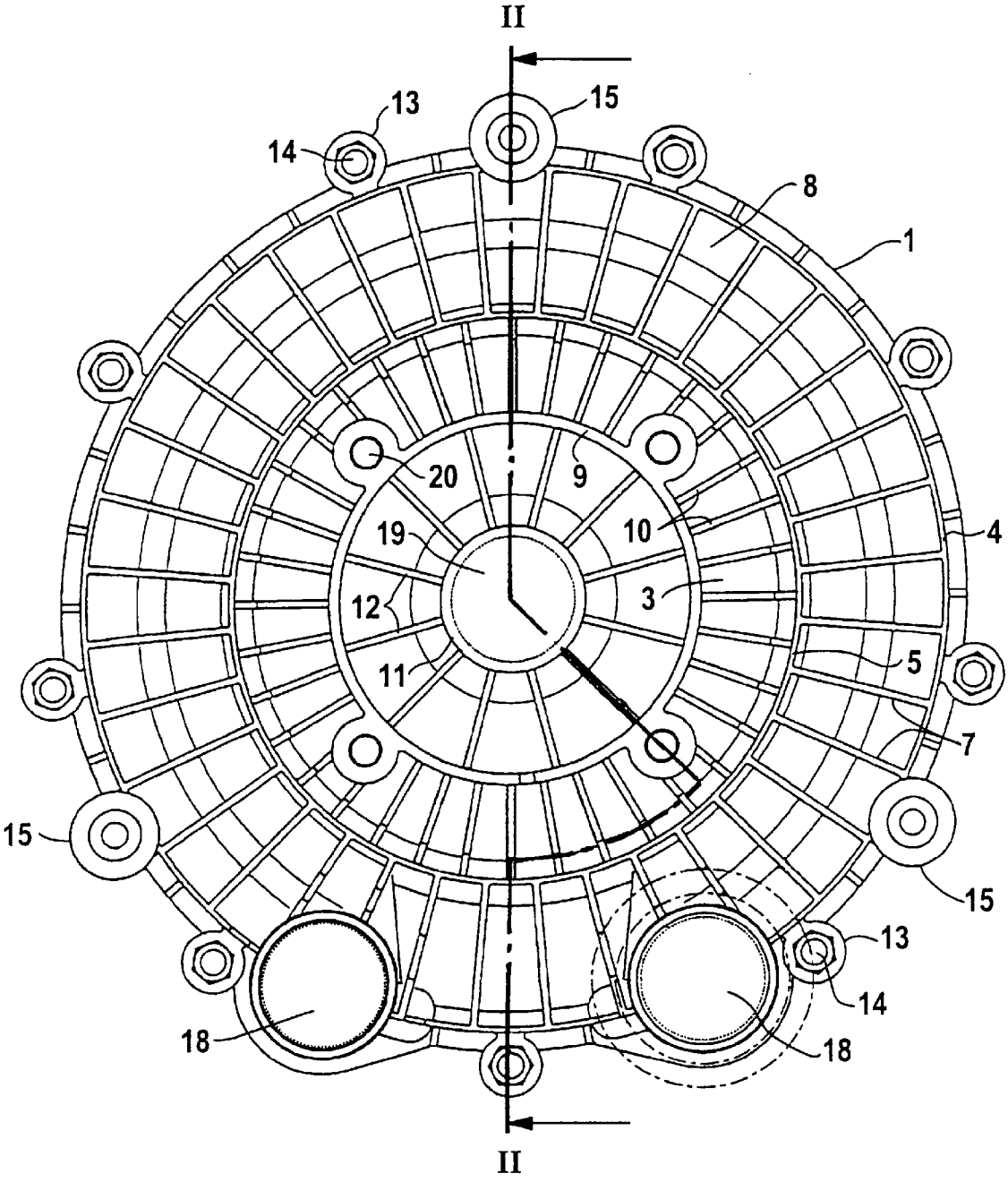
FIG. 1 shows a top view of a housing half of a side channel compressor housing.
Figure 2:
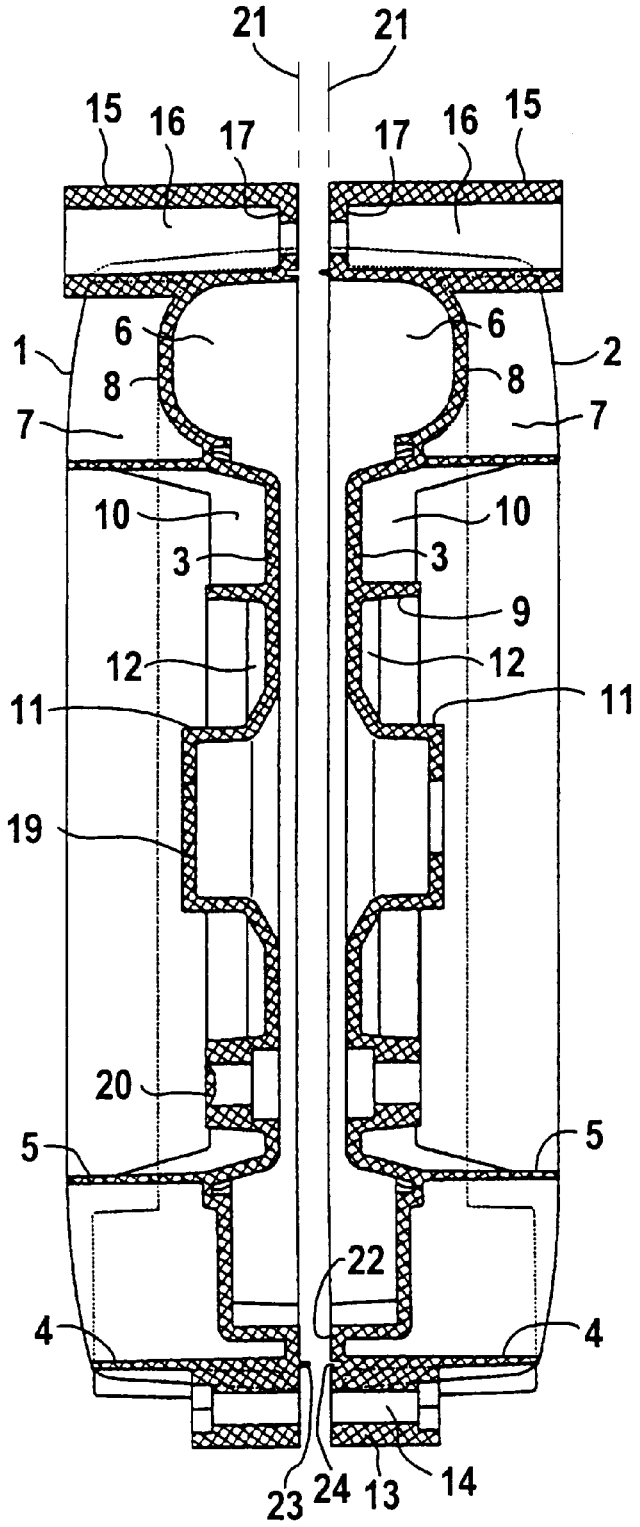
FIG. 2 shows the two housing halves of a side channel compressor housing in section along the line II—II in FIG. 1.

The two housing halves of a side channel compressor housing are designated by reference numerals 1 and 2. A first and second ring 4 and 5 are formed on the front wall 3 of each housing half. The rings 4 and 5 project axially relative to the front wall 3 and are spaced radially from one another. The radius of the first ring 4 corresponds approximately to the outer radius of the side channel 6 formed in each housing half 1 and 2 and the radius of the second ring corresponds approximately to the inner radius of the side channel 6.

Between the first and second ring 4 and 5, rib walls 7 extending in a spoke-like manner are formed on the outside of the wall part 8 constituting the side channel 6. These rib walls 7 appreciably increase, in particular, the strength of this wall part 8 which is subjected particularly severely to the compression pressure.

A centering ring 9 is provided on the front wall 3 of each housing half 1 and 2 located concentrically relative to the two rings 4 and 5 and radially further inward. Formed in the region between this centering ring 9 and the adjacent second ring 5 are further rib walls 10 which are arranged in a manner staggered relative to the rib walls 7 extending between the first and second ring 4 and 5. The load forces are thereby also introduced into the second ring 5 which thus contributes to an increase in strength.

Radially extended reinforcing ribs 12 are additionally formed on the front wall 3 between the centering ring 9 and a hub extension 11 of the housing halves 1 and 2, the hub extension 11 being located radially even further inward. The number of these reinforcing ribs 12 is reduced to one third in relation to the number of rib walls 7 and of further rib walls 10 on account of the considerably smaller circumference of the hub extension 11 in comparison with the circumference of the centering ring 9. The reinforcing ribs 12 are once again arranged in a manner staggered relative to the further rib walls 10.

As can be seen from the top view of FIG. 1, lugs 13, which are provided with insertion orifices 14 for connecting screws, are formed in one piece on the circumference of the housing halves 1 and 2. By means of such screws, the two housing halves 1 and 2 can be connected to form a side channel compressor housing.

Moreover, three tubular foot parts 15 are provided in a manner distributed uniformly over the circumference of the housing halves 1 and 2. Formed in the cavity 16 of the foot parts 15 is a stop shoulder 17 which projects radially inward and on which can rest the screw head of fastening screws which are introduced into the foot parts 15 when the side channel compressor is erected with a vertical axis.

Furthermore, prestampings 18 for an inlet and an outlet orifice are provided on the housing halves 1 and 2. These prestampings 18 are then removed on the corresponding housing half. There are likewise prestampings 19 for a shaft introduction orifice and prestampings 20 for fastening holes on the housing halves. These prestampings 19 and 20 are then likewise removed on the corresponding housing halves.

The housing halves 1 and 2 can therefore be designed in the same form, that is to say identically. For this purpose, it is merely necessary to arrange the foot parts 15 and prestampings 18 to 20 symmetrically in relation to a bisecting line which runs in the middle between the prestampings 18 for the inlet and outlet orifices.

Provided in each case at the end circumferential edge 22 located in the parting plane 21 of the housing halves 1 and 2 are a sealing lip 23 extending on one side of the bisecting line over one half of the circumference and a sealing groove 24 extending on the other side of the bisecting line over the other half of the circumference. When the housing halves 1 and 2 are assembled, the sealing lips 23 and the sealing grooves 24 engage one in the other and ensure good sealing of the parting gap between the two interconnected housing halves 1 and 2.

I claim:

1. A housing for a side channel compressor, wherein the housing comprises two housing halves, each housing half comprising:

(a) a first ring and a second ring on a front wall of the housing half, said rings being set apart radially from one another and projecting axially relative to the front wall, wherein the radius of the first ring corresponds approximately to an outer radius of a side channel formed in the housing halves and the radius of the second ring corresponds approximately to an inner radius of the side channel formed in the housing halves, and (b) rib walls, extending in a spoke-like manner, pre-molded between the first ring and the second ring.

2. A housing as defined by claim 1, wherein the front wall has formed on it, in addition to the first and second rings, an axially extended centering ring located radially further inward of the first and second rings, and wherein further rib walls extending in a spoke-like manner are provided on the front wall between the centering ring and the ring adjacent to said centering ring.

3. A housing as defined by claim 2, wherein the further rib walls are arranged in a manner staggered relative to the rib walls.

4. A housing as defined by claim 2, wherein radially extended reinforcing ribs are additionally also formed on the front wall between the centering ring and a hub extension located radially further inward relative to said centering ring.

5. A housing as defined by claim 3, wherein radially extended reinforcing ribs are additionally also formed on the front wall between the centering ring and a hub extension located radially further inward relative to said centering ring.

6. A housing as defined by claim 1, wherein there are provided on each housing half, at an end circumferential edge located in a parting plane of the housing halves, a sealing lip extending over one half of the circumference and a sealing groove extending over the other half of the circumference.

7. A housing as defined by claim 4 wherein there are provided on each housing half, at an end circumferential edge located in a parting plane of the housing halves, a sealing lip extending over one half of the circumference and a sealing groove extending over the other half of the circumference.

8. A housing as defined by claim 5 wherein there are provided on each housing half, at an end circumferential edge located in a parting plane of the housing halves, a sealing lip extending over one half of the circumference and a sealing groove extending over the other half of the circumference.

9. A housing as defined by claim 6, wherein the sealing lip and the sealing groove extend in each case on one side and the other in relation to a symmetrical dividing line of the housing halves.

10. A housing as defined by claim 7, wherein the sealing lip and the sealing groove extend in each case on one side and the other in relation to a symmetrical dividing line of the housing halves.

11. A housing as defined by claim 8, wherein the sealing lip and the sealing groove extend in each case on one side and the other in relation to a symmetrical dividing line of the housing halves.

* * * * *